United States Patent [19]

Maio et al.

[11] Patent Number: 4,757,937

[45] Date of Patent: Jul. 19, 1988

[54] EASY SET-UP TRAY

[75] Inventors: Patrick S. Maio, Ringwood; Joseph K. Murphy, Riverdale, both of N.J.

[73] Assignee: Federal Paper Board Co., Inc., Montvale, N.J.

[21] Appl. No.: 891,648

[22] Filed: Aug. 1, 1986

[51] Int. Cl.[4] ..... B65D 5/24; B65D 5/36

[52] U.S. Cl. ..... 229/41 B; 206/562; 229/120.08; 229/904

[58] Field of Search ..... 229/41 R, 41 B, 28 R, 229/169, 170, 904; 206/562–565

[56] References Cited

U.S. PATENT DOCUMENTS

| | | | |
|---|---|---|---|
| 2,670,124 | 2/1954 | Buchmiller et al. | 229/43 |
| 2,679,971 | 6/1954 | Goldberg | 229/178 |
| 2,734,677 | 2/1956 | Arneson | 229/41 B |
| 2,833,458 | 5/1958 | Toensmeier | 229/28 R |
| 3,009,623 | 11/1961 | Wenzel | 229/904 |
| 3,149,770 | 9/1964 | Spillson | 229/904 |
| 3,189,247 | 6/1965 | Wischusen | 229/41 B |

FOREIGN PATENT DOCUMENTS

| | | | |
|---|---|---|---|
| 1563383 | 3/1980 | United Kingdom | 229/41 B |

*Primary Examiner*—Stephen Marcus
*Assistant Examiner*—Gary E. Elkins
*Attorney, Agent, or Firm*—Charles E. Brown; Charles A. Brown

[57] ABSTRACT

An easy set-up tray wherein in addition to the usual well defined by a tray for receiving food products, there is a top panel for receiving other products, including containers for drinks and the like. Each tray is of a one-piece construction and is provided in a substantially flat knocked-down state. When it is desired to erect or set-up the tray, side panels thereof are grasped and pulled apart with the result that the tray automatically erects and is locked in its erected or set-up position. The top panel is connected to the side panels by reversely foldable connecting panels so as to provide for a rigid structure.

17 Claims, 3 Drawing Sheets

EASY SET-UP TRAY

This invention relates to new and useful improvements in trays to be utilized in dispensing fast foods, and more particularly to an automatic set-up tray.

Most particularly, this invention relates to a tray which is provided at at least one end thereof with a top panel which may be provided with openings for receiving drinks, leaving a well for receiving other food products.

A principal feature of the invention is that the tray may be shipped in a flat folded state and by grasping and pulling apart side panels thereof, the tray may be automatically set-up or erected.

One of the features of the invention is that the top panel carries a locking panel which, when the tray is erected, extends between the side panels and maintains the tray in its erected state. This feature per se is known in the patent to Goldberg U.S. Pat. No. Re. 24,233. However, the Goldberg patent does not teach the formation of a stable tray in that the top panel is not fixedly secured relative to the side panels. In accordance with this invention, there are reversely folded connecting panels between remote sides of the top panel and the side panels.

In addition, the end panel of the basic tray adjacent the top panel is of a reversely folded construction so as to facilitate the erection of the tray.

Another additional feature which may be incorporated in the tray is the provision of support panels extending inwardly of the tray from the side panels and underlying the top panel so as to effectively support the same against downward deflection when a cup or the like is forced into an opening in the top panel so as to prevent collapse of the top panel.

With the above and other objects in view that will hereinafter appear, the nature of the invention will be more clearly understood by reference to the following detailed description, the appended claims, and the several views illustrated in the accompanying drawings.

Figure 2:
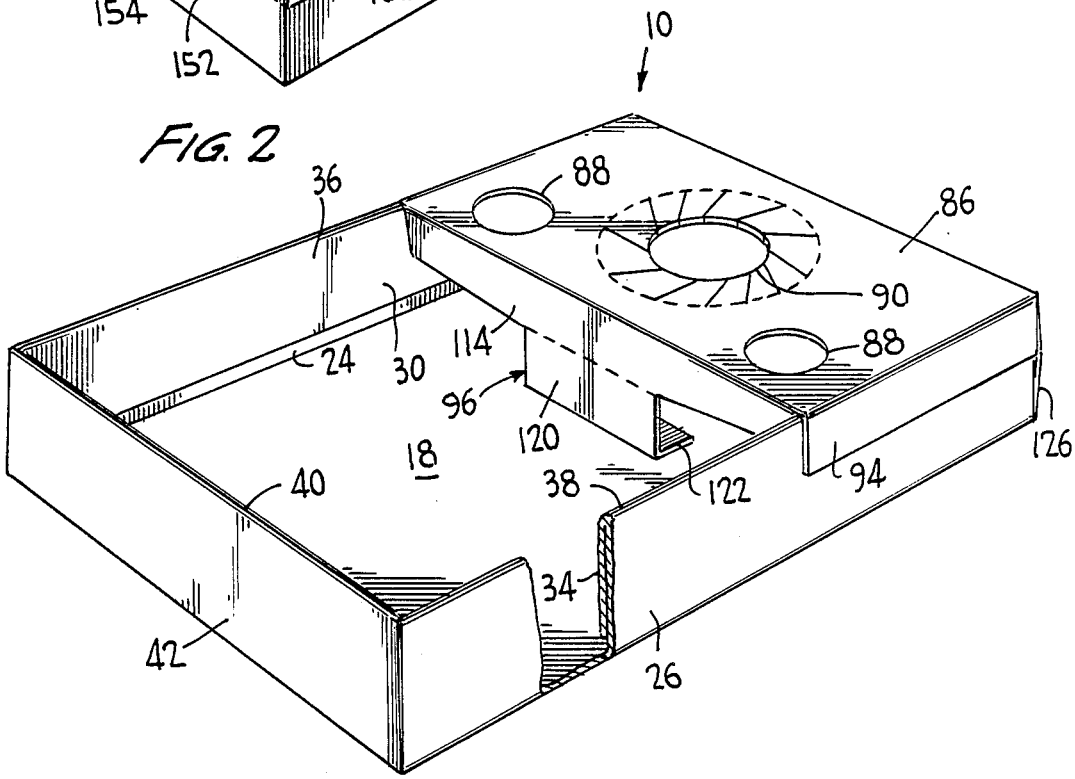
FIG. 2 is a top perspective view of a modified form of tray having a top panel at only one end thereof, a portion of a side panel thereof being broken away and shown in section to illustrate the double wall construction thereof.
Figure 3:
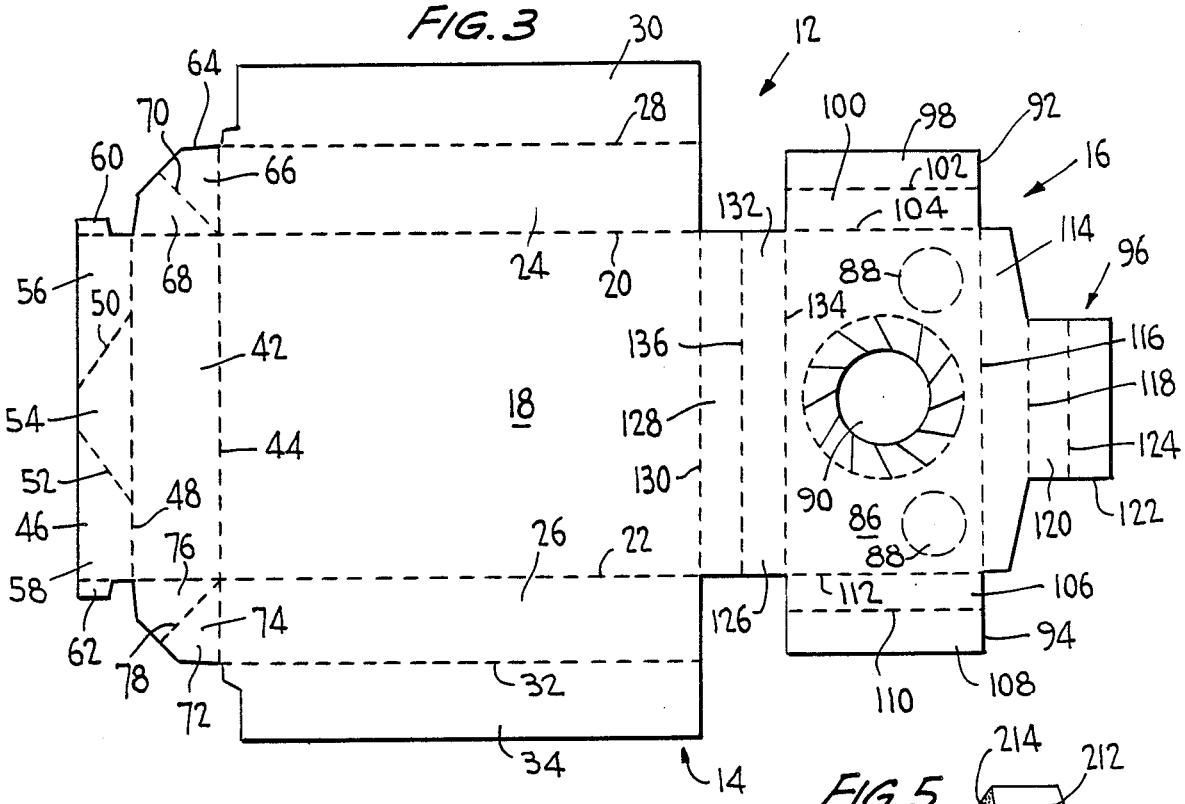
FIG. 3 is a plan view of a blank from which the carton of FIG. 2 is formed.

Reference is now made first to FIG. 2 wherein there is illustrated an easy set-up tray formed in accordance with this invention, the tray being generally identified by the numeral 10. The tray 10 is formed from the blank 12 which is illustrated in FIG. 3. The tray 10 will be best understood by first describing the blank 12.

The blank 12 includes a first portion 14 which defines a basic tray, and a second portion 16 which relates to the top panel.

The basic tray first portion 14 includes a centrally located bottom panel 18 having connected along opposite sides thereof by way of fold lines 20, 22 side panels 24, 26, respectively.

The side panel 24 has hingedly connected thereto along a fold line 28 a further side panel 30. In a like manner, the side panel 26 has hingedly connected thereto along a fold line 32 a further side panel 34. The side panels 30, 34 are disposed outermost in the blank 12, but are inner side panels in the erected tray as is clearly illustrated in FIG. 2.

The side panels 24, 30 combine to define in the tray 10 a side panel 36 while the side panels 26, 34 combine to form in the tray 10 a side panel 38. The side panels 36 and 38 are of a double wall construction.

As is clearly shown in FIG. 2, the tray 10 has an end panel 40 which is also of a double wall construction and is formed by way of an end panel 42 which is connected to the bottom along a fold line 44. The end panel 42 in turn carries an end panel 46 which is connected thereto along a fold line 48.

It will be seen that the end panel 46 is divided by converging fold lines 50, 52 into a central securing flap 54 and remote locking panels 56, 58. The locking panels 56 and 58 hingedly carry locking tabs 60, 62, respectively.

The side panels 24 and 26 are connected to the end panel 42 by corner flaps. A corner flap 64 formed of two generally triangular flaps 66, 68 connected together by an intermediate fold line 70 are connected to the side panel 24 and the end panel 42. A like corner flap 72 formed of triangular corner flaps 74, 76 joined by a fold line 78 extends between the side panel 26 and the end panel 42.

Figure 4:
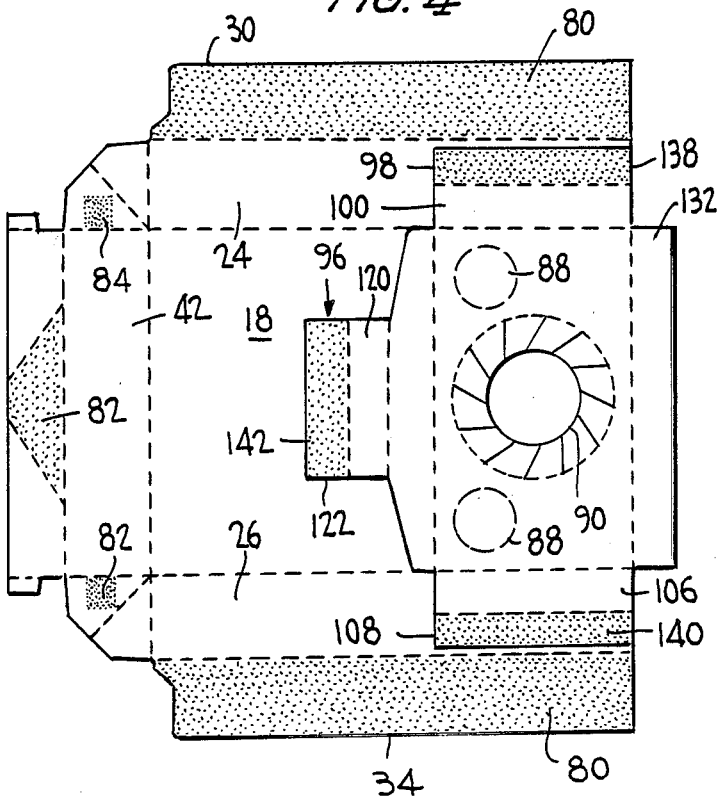
FIG. 4 is a plan view of the blank of FIG. 3 which is partially reversely folded on itself for receiving an application of adhesive with the adhesive all being applied from the same side of the blank.

It is to be understood that in the erected state of the tray 10, the side panels 30, 34 are reversely folded over the side panels 24, 26, respectively and adhesively bonded thereto by means of adhesive 80, as is best shown in FIG. 4. In a like manner, the flap 54 will be provided with adhesive 82 and bonded thereby to the end panel 42 when the end panel 46 is folded into overlying relation with respect to the end panel 42. Finally, the corner flaps 68 and 76 will be bonded by way of adhesive 84 to the end panel 42.

Thus there is provided an open ended tray which may be folded to a substantially flat state which may be erected by merely pulling apart the side panels 36, 38.

The second portion 16 of the blank 12 includes a centrally located top panel 86 which may have suitable openings 88, 90 therethrough for receiving cups and the like.

The top panel 86 carries along opposite edges thereof reversely foldable connecting panels 92, 94 and there is carried by the top panel 86 remote from the first portion 14 a reversely foldable connecting panel 96. The connecting panel 92 includes a pair of panels 98, 100 which are connected to each other along a fold line 102 with the connecting panel 100 being connected to a side edge of the top panel 86 along a fold line 104. In a like manner, the connecting panel 94 includes a pair of panels 106, 108 which are connected together along a fold line 110 and with the connecting panel 106 being connected to the top panel 86 along a fold line 112.

The connecting panel 96 is carried by a locking panel 114 which is connected to a remote end of the top panel 86 along a fold line 116. The connecting panel 96 is, in turn, connected to the locking panel 114 along a fold line 118. The connecting panel 96 is formed of two panels 120, 122 which are connected together along a fold line 124.

Finally, the portions 14 and 16 of the blank 12 are integrally connected together by a reversely foldable second end panel 126 which includes a panel 128 which is connected to the bottom along a fold line 130 and a panel 132 which is connected to the top panel 86 along a fold line 134. The panels 128, 132 are connected together along a fold line 136.

Returning now to FIG. 4, it will be seen that when the end panel 126 is folded upon itself along the fold line 136, the top panel 86 will overlie the bottom panel 18 at one end thereof and further adhesive 138, 140 and 142 may be applied to the panels 98, 108 and 122, respectively. In this manner, the connecting panels 98 and 108 may be bonded to the outer surfaces of the panels 24 and 26 which form the outer surfaces of the side panels 36, 38. At the same time, the connecting panel 122 may be adhesively bonded to the bottom 18.

When the various portions of the blank 12 are adhesively bonded together, the tray 10 will still be in a flat state suitable for shipment and storage in a compact form. When it is desired to utilize the tray 10, the side panels 36, 38 are grasped by an operator and the person's thumbs are pulled apart so as to move the side panels 36 and 38 from their folded positions overlying the bottom 18 to upstanding positions which results in the end panels 40, 128 also assuming upstanding positions and with the locking panel 114 extending between the side panels 36, 38 and preventing the side panels 36, 38 from moving together as would be required for the tray 10 to again assume its folded state.

Inasmuch as the top panel 86 is securely connected along all four edges thereof to other portions of the tray 10, including the sides edges of the top panel 86 being connected to the side panels 36, 38 by the connecting panels 92, 94, respectively, there results a very rigid tray construction.

Figure 1:
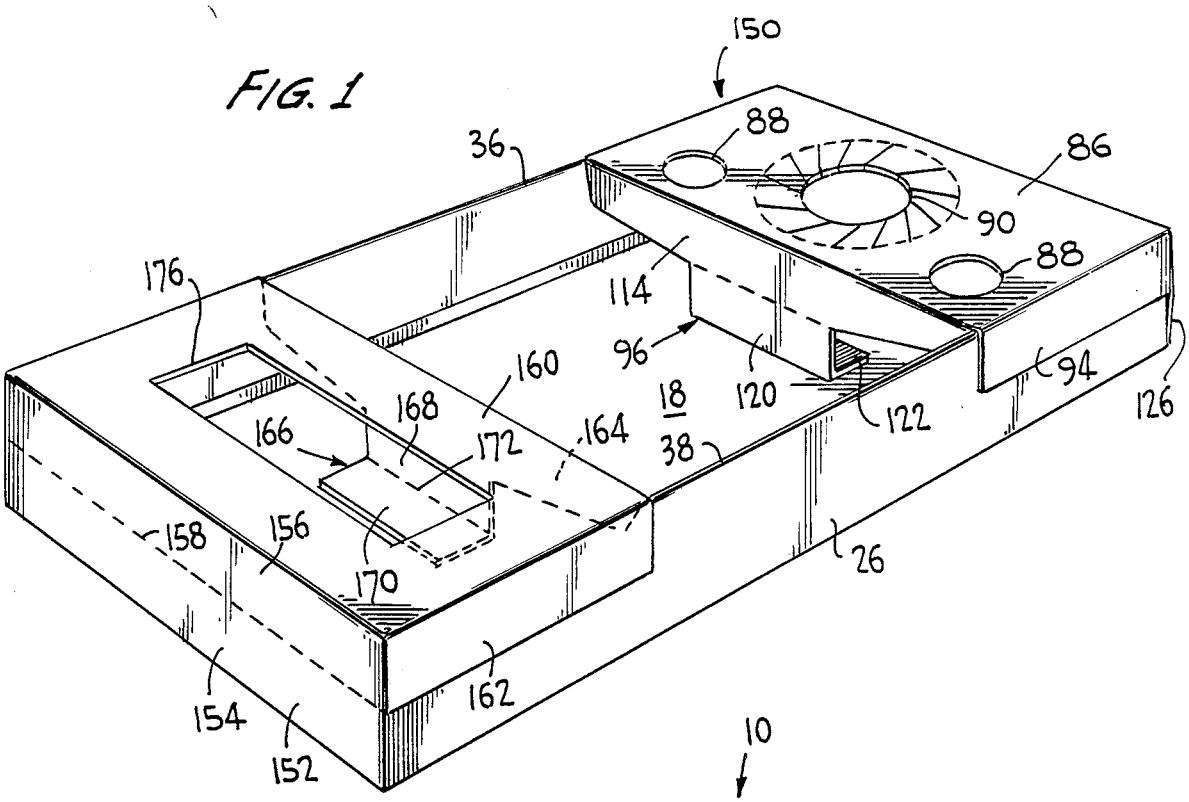
FIG. 1 is a top perspective view of one form of tray formed in accordance with this invention and shows generally the details thereof.

Reference is now made to FIG. 1 wherein a modified form of tray, generally identified by the numeral 150, is illustrated. The tray 150 differs from the tray 10 in that in lieu of the end panel 40 there is provided an end panel 152 which corresponds to the end panel 126 which is at the opposite end of the tray. The end panel 152 includes a lower portion 154 which is joined to the bottom wall 18 and an upper portion 156 which is joined to the lower portion along a fold line 158.

The modified end of the tray 150 also includes a top panel 160 which is hingedly connected to the end panel 152 and is further connected to the side panels 36 and 38 by reversely folded connecting panels of which only a connecting panel 162 is illustrated. The connecting panels will correspond to the connecting panels 92, 94 of the opposite end of the tray.

At the edge of the top panel 160 remote from the end panel 152 is a depending locking panel 164 which corresponds to the locking panel 114. The locking panel 164 carries a reversely [illegible]lable connecting panel arrangement 166 which [illegible]sponds to the connecting panel arrangement 9[illegible] carried by the top panel 86. The connecting panel arrangement 166 includes a vertical panel 168 which is hingedly connected to the lower end of the locking panel 164 and a lower panel 170 which is hingedly connected to the panel 168 along a fold line 170 and by which it is adhesively bonded to the bottom 18.

At this time it is pointed out that the tray 150 may be longer than the tray 10 with the result that the bottom panel 18 and the side panels 36, 38 of the tray 150 may be longer than the corresponding portions of the tray 10.

In order that a food product may be inserted through the top panel 160, an opening 176 is formed in the top panel. The configuration of the opening 176 may vary in accordance with the intended food product.

Figure 7:
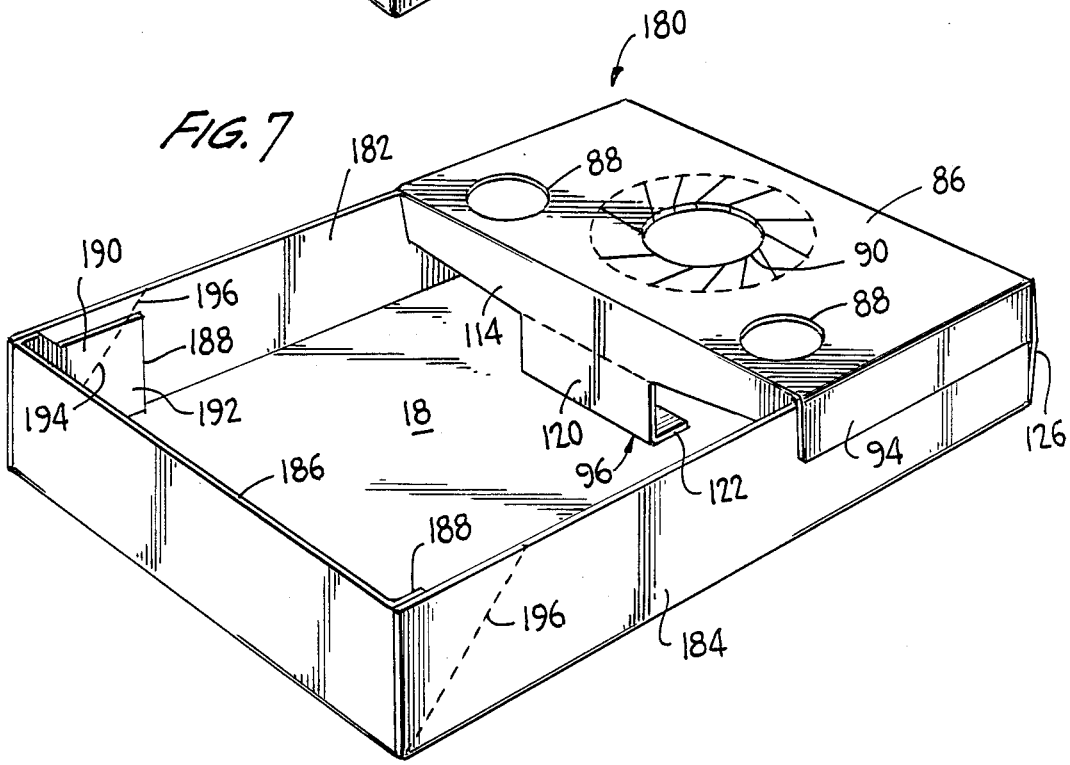
FIG. 7 is another perspective view of a modified form of tray similar to FIG. 2 but shows a tray wherein the side panels are of a single wall construction.

Reference is now made to FIG. 7 wherein there is illustrated yet another form of tray generally identified by the numeral 180. The tray 180 differs from the tray 10 in that the side panels thereof, which are identified by the numerals 182, 184, are of a single thickness as opposed to the double thickness of the side panels 36, 38 of the tray 10. Furthermore, in lieu of the double thickness end panel 40, there is a single thickness end panel 186. The end panel 186 carries securing tabs 188. Each securing tab 188 is divided into two parts, an upper part 190 and a lower part 192 which are divided by a fold line 194. The upper part 190 is bonded to the inner surface of the respective side panel 182, 184. Furthermore, the side panels 182, 184 are provided adjacent the end panel 186 with diagonal fold lines 196. Thus when the tray 180 is in its folded state, the end panel 186 as well as the side panels 182, 184 may overlie the bottom 18 and still be readily erected.

Figure 5:
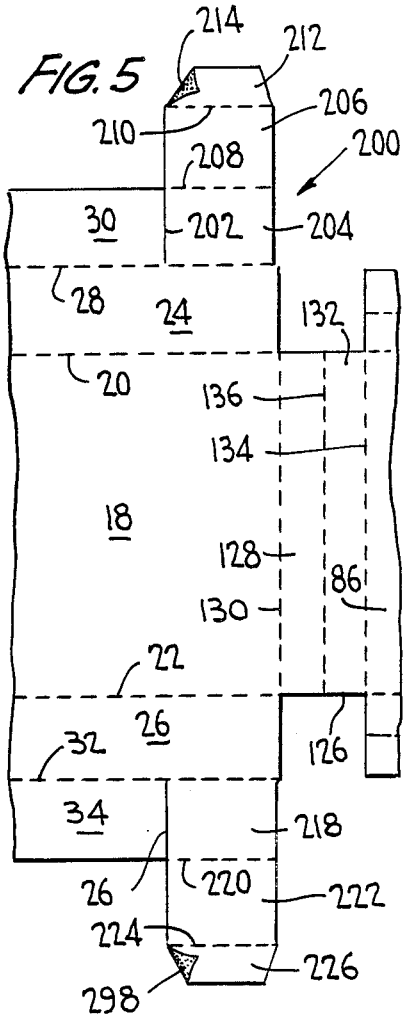
FIG. 5 is a fragmentary plan view of an intermediate portion of a modified form of blank which includes a support for the top panel.

Reference is now made to FIG. 5 wherein there is illustrated a modified form of blank, generally identified by the numeral 200. Only a central portion of the blank 200 is illustrated in that only the central portion thereof differs from the blank 12. The blank 200 provides a support for the top panel 86 by terminating the side panel 30 short of the side panel 24 on one side of the blank and terminating the side panel 34 short of the end of the side panel 26 on the opposite side of the blank. Thus a cut line 202 extends across the side panel 30 and forms at the right end thereof what becomes a support panel 204. The support panel 204 carries a panel 206 along a fold line 208 with the panel 206 becoming an upstanding leg. The panel 206, in turn, carries along a fold line 210 a panel which forms a foot 212. The foot 212 has adhesive 214 thereon for bonding the same to the bottom 18.

At the opposite side of the blank 200, there is a cut line 216 which extends across the side panel 34 and defines a support panel 218. The support panel 218 has connected thereto along a hinge line 220 a panel forming an upstanding leg 222 which, in turn, has connected thereon along a fold line 224 a panel which becomes a foot 226 which is secured to the bottom 18 by adhesive 228.

Figure 6:
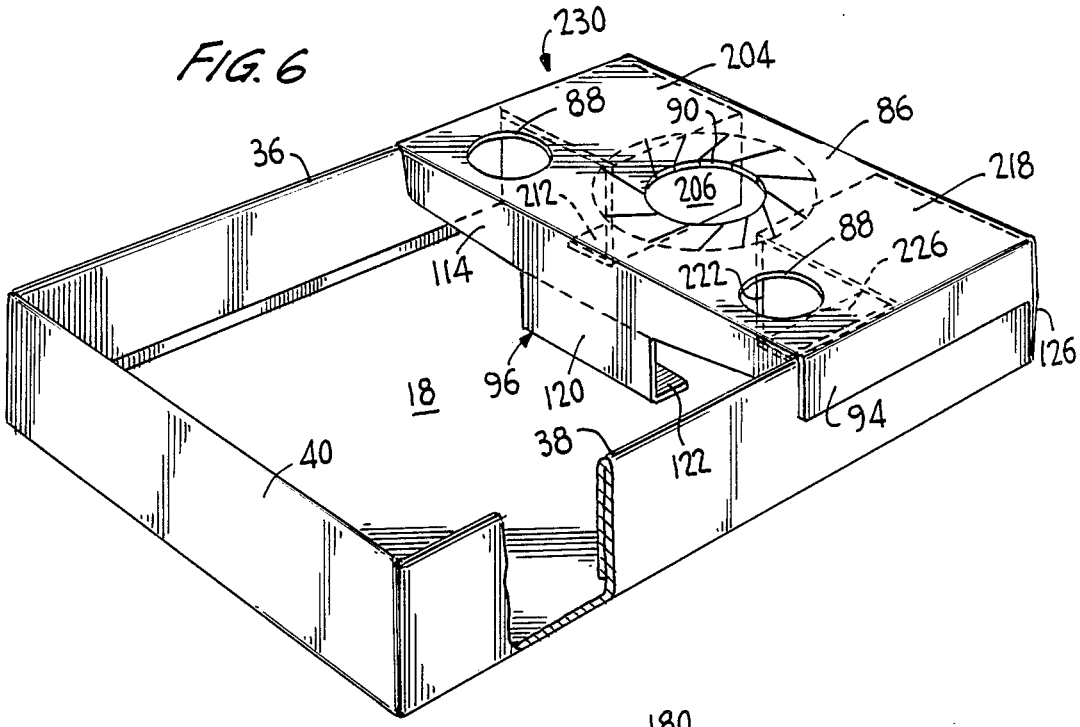
FIG. 6 is a perspective view similar to FIG. 2 of a modified form of tray wherein the supports for the top panel are utilized.

Reference is now made to FIG. 6 wherein there is illustrated a tray 230 which is formed from the blank 200. The tray 230 is identical to the tray 10 except for the addition of the support for the top panel 86. As will be apparent from FIG. 6, the top panel 86 is supported on opposite sides thereof by the support panels 204, 218 which extend horizontally from the upper edges of the side panels 36, 38. The support panels 204, 218 are supported at their inner edges by the upstanding walls formed by the panels 206, 222 which, in turn, are secured to the bottom 18 by the feet forming panels 212, 226.

Although only several preferred embodiments of trays and blanks for forming the same have been specifically illustrated and described herein, it is to be understood that minor variations may be made in the tray construction without departing from the spirit and scope of the invention as defined by the appended claims.

We claim:

1. An easy set up tray for receiving a drink and food like products, said tray comprising a bottom, side panels and end panels hingedly carried by said bottom, a top panel at at least one end of said tray, said top panel being connected to said bottom and said side panels by reversely foldable pairs of connecting panels, each pair of connecting panels including one connecting panel hingedly connected to said top panel and one connecting panel hingedly connected to a respective one of said bottom and said side panels whereby said tray may have a flat storage state and may be readily erected by moving apart said side panels, and said top panel carrying remote from said one end a locking panel for extending between said side panels and thereby locking said tray in the open state.

2. A tray according to claim 1 wherein said locking panel carries one of said reversely foldable pairs of connecting panels.

3. A tray according to claim 1 wherein said locking panel carries one of said reversely foldable pairs of connecting panels, and connecting panels of said one pair of connecting panels are open relative to one another in the erected state of said tray and closed relative to one another in the folded state of said tray.

4. A tray according to claim 1 wherein connecting panels of said pairs of connecting panels connected to said side panels are closed relative to one another in the erected state of said tray and open relative to one another in the folded state of said tray.

5. A tray according to claim 1 wherein that one of said end panels at said tray one end integrally connects said top panel to said bottom.

6. A tray according to claim 1 wherein that one of said end panels at said tray one end integrally connects said top panel to said bottom and is reversely foldable.

7. A tray according to claim 1 wherein that one of said end panels at said tray one end integrally connects said top panel to said bottom and is reversely foldable, said one end panel including a pair of panels which are open relative to one another in the erected state of said tray and closed in the folded state of said tray.

8. A tray according to claim 1 together with top panel supports extending in the interior of said tray from said side panels and secured to said bottom.

9. A tray according to claim 8 wherein each top panel support includes an upper support panel, a vertical support panel, and a foot, said foot being secured to said bottom.

10. A tray according to claim 9 wherein said side panels are of a double thickness and include inner and outer side panels, and said upper support panel is at least in part formed from a portion of said inner side panel.

11. A tray according to claim 1 wherein said tray includes a well adjacent said top panel.

12. A tray according to claim 1 wherein said tray includes a well adjacent said top panel, said well extending to an opposite end of said tray.

13. A tray according to claim 1 wherein there is a top panel at an opposite end of said tray, and there is a well between said top panels.

14. A blank for forming an easy set up tray, said blank including a first portion for defining a tray including a bottom, one end panel and side panels, a second end panel integrally connected to said bottom remote from said one end panel and connecting a second portion to said first portion, said second portion including a centrally located top panel and pairs of reversely foldable connecting panels at opposite sides of said top panel and at an end of said top panel remote from said second end panel.

15. A blank according to claim 14 wherein there is a locking panel positioned between said top panel and said reversely foldable connecting panels at the remote end of said top panel for locking the resultant tray in an erected state.

16. A blank according to claim 14 wherein said side panels include inner and outer side panels, each of said outer side panels terminates short of one end thereof adjacent said second end panel with the remaining part of each outer side panel forming a support panel for said top tray.

17. A blank according to claim 16 wherein each support panel carries a further support panel and a foot.

* * * * *